United States Patent [19]

Doeberl et al.

[11] Patent Number: 5,075,862

[45] Date of Patent: Dec. 24, 1991

[54] SYSTEM FOR PRINTING VALUE INDICIA WITH DIAGRAMMATIC DATA REPRESENTATION

[75] Inventors: Terrence M. Doeberl, West Redding; Michael P. Taylor, Norwalk, both of Conn.

[73] Assignee: Pitney Bowes Inc., Stamford, Conn.

[21] Appl. No.: 456,873

[22] Filed: Dec. 26, 1989

[51] Int. Cl.[5] ..... G07B 17/04

[52] U.S. Cl. ..... 395/117; 283/71; 283/114

[58] Field of Search ..... 235/380; 283/17, 71, 283/72, 114; 364/464.02, 519; 380/54

[56] References Cited

U.S. PATENT DOCUMENTS

| | | | |
|---|---|---|---|
| 3,869,986 | 3/1975 | Hubbard | 101/91 |
| 3,889,592 | 6/1975 | Lupkas et al. | 101/93.47 |
| 3,890,599 | 6/1975 | Simjian | 340/149 R |
| 3,990,362 | 9/1976 | Check et al. | 101/93.37 |
| 4,241,994 | 12/1980 | Ryan, Jr. | 355/40 X |
| 4,334,771 | 6/1982 | Ryan, Jr. | 283/114 X |
| 4,637,051 | 1/1987 | Clark | 382/1 |
| 4,641,346 | 2/1987 | Clark et al. | 380/3 |
| 4,641,347 | 2/1987 | Clark et al. | 380/3 |
| 4,649,266 | 3/1987 | Eckert et al. | 235/432 |
| 4,660,221 | 4/1987 | Dlugos | 380/23 |
| 4,673,303 | 6/1987 | Sansone et al. | 400/126 |
| 4,725,718 | 2/1988 | Sansone et al. | 235/495 |
| 4,743,747 | 5/1988 | Fougere et al. | 235/494 |
| 4,757,537 | 7/1988 | Edelmann et al. | 380/51 |
| 4,775,246 | 10/1988 | Edelmann | 380/23 |
| 4,812,994 | 3/1989 | Taylor | 364/464.02 |
| 4,824,144 | 4/1989 | Tasma | 283/114 X |
| 4,829,568 | 5/1989 | Clark et al. | 380/23 |
| 4,835,713 | 5/1989 | Pastor | 364/519 |
| 4,864,618 | 9/1989 | Wright et al. | 380/51 |
| 4,907,162 | 3/1990 | Fougere | 364/464.02 |
| 4,949,381 | 8/1990 | Pastor | 380/54 X |

*Primary Examiner*—Parshotam S. Lall
*Assistant Examiner*—Edward R. Cosimano
*Attorney, Agent, or Firm*—Nathaniel Levin; Melvin J. Scolnick; Robert H. Whisker

[57] ABSTRACT

A value printing system includes a printer that prints an indicia. The indicia represents a value. The system also includes an apparatus for controlling the printer and an apparatus for accounting for the value represented by the indicia. The indicia includes one or more markers that present numerical data in the form of a diagram. Alternatively, the indicia includes one or more locations in which the presence or absence of a marker authenticates the indicia. An overlay may be provided to aid in interpreting the markers.

14 Claims, 16 Drawing Sheets

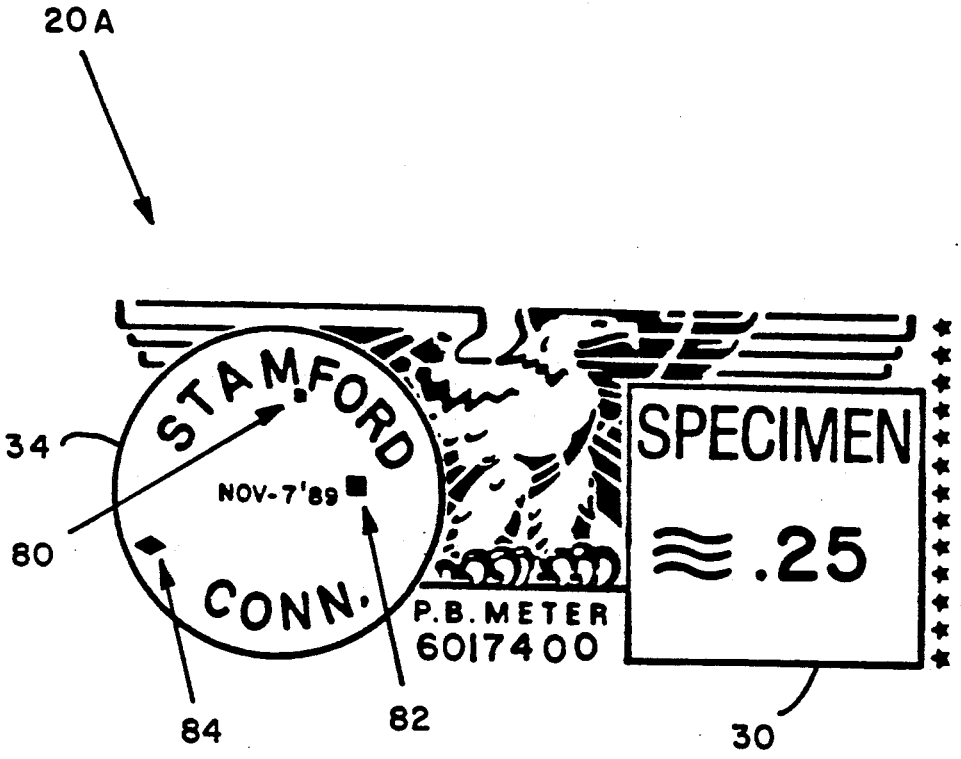
FIG. 3-A
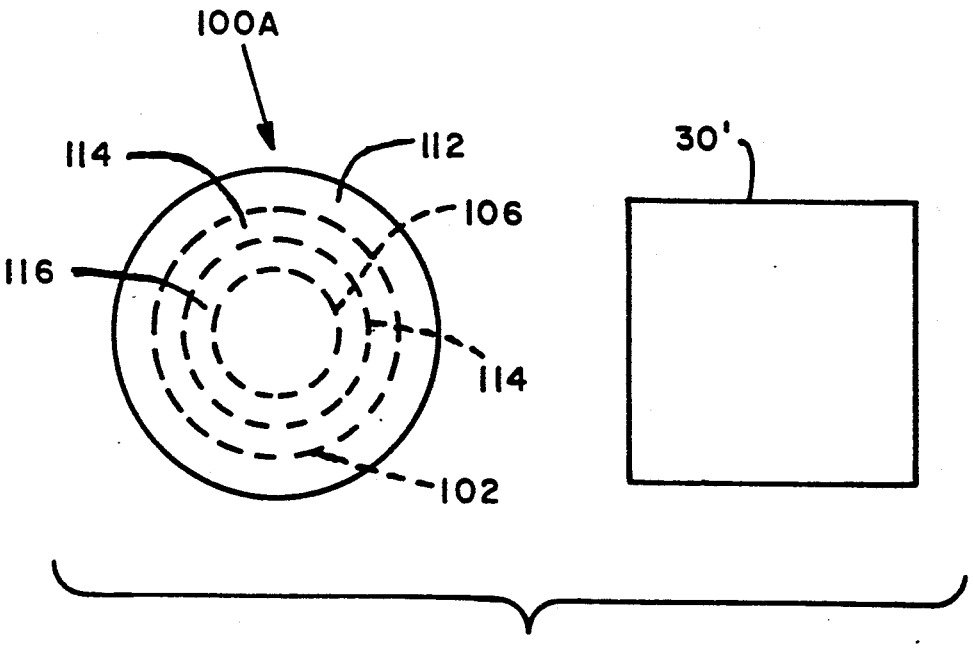
FIG. 3-B

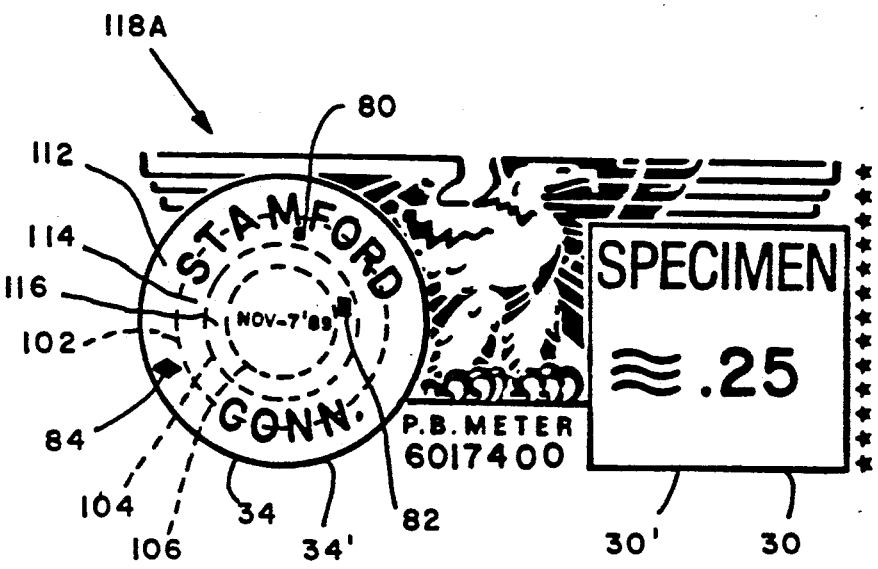
FIG. 3-C
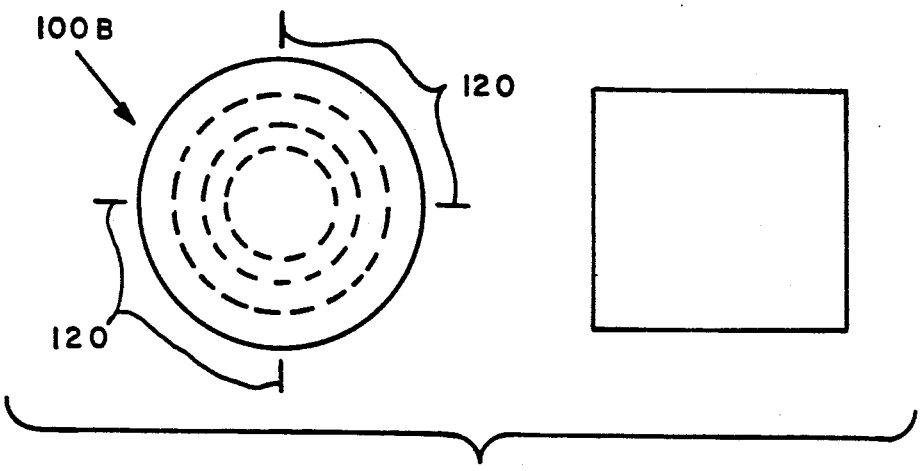
FIG. 3-D
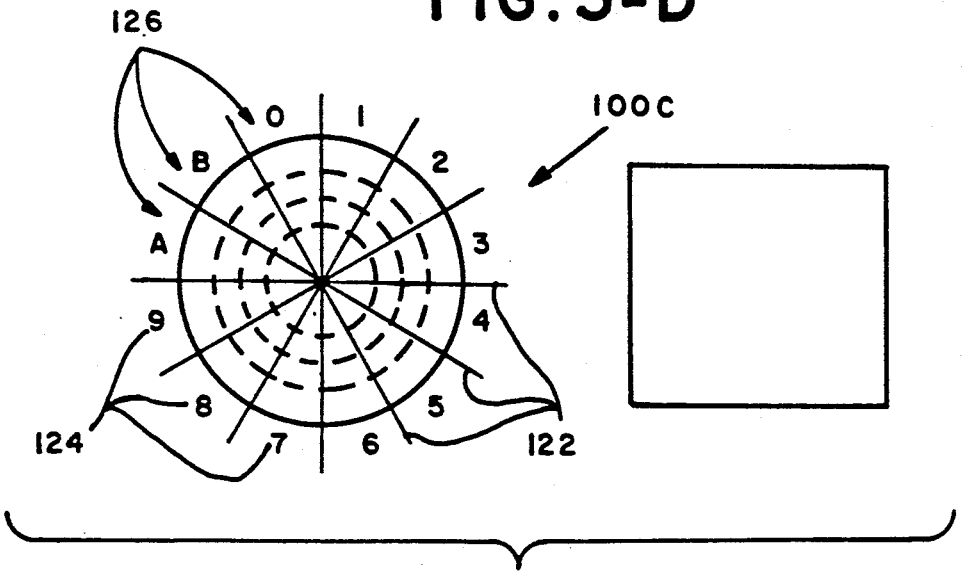
FIG. 3-E

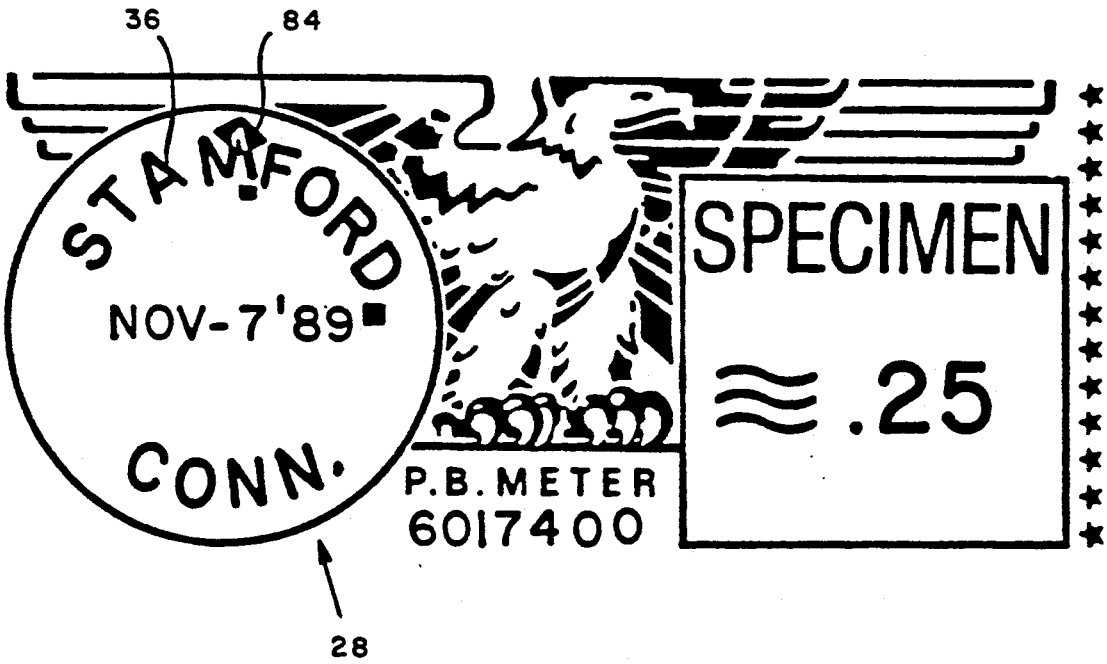
FIG. 3-F

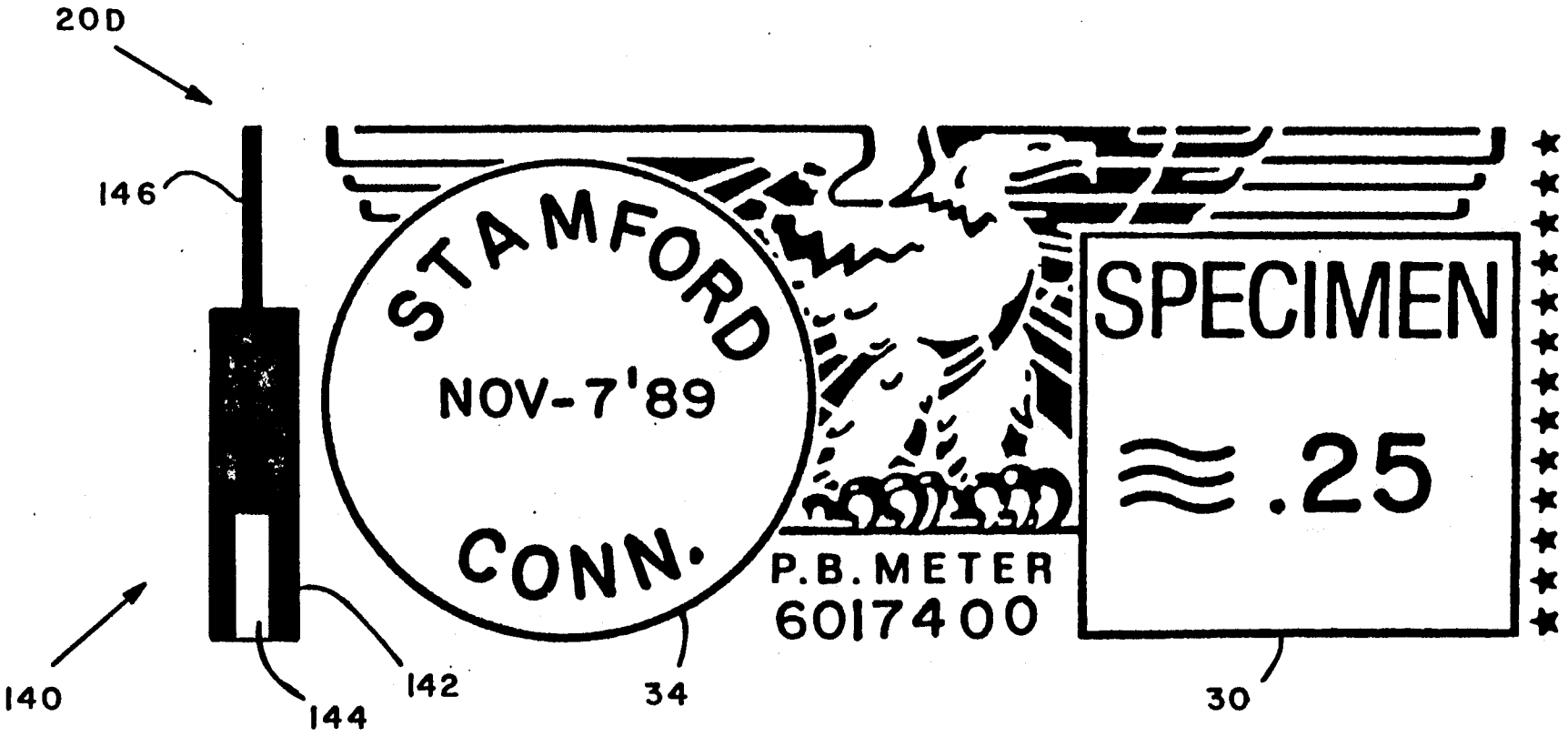
FIG. 4-A

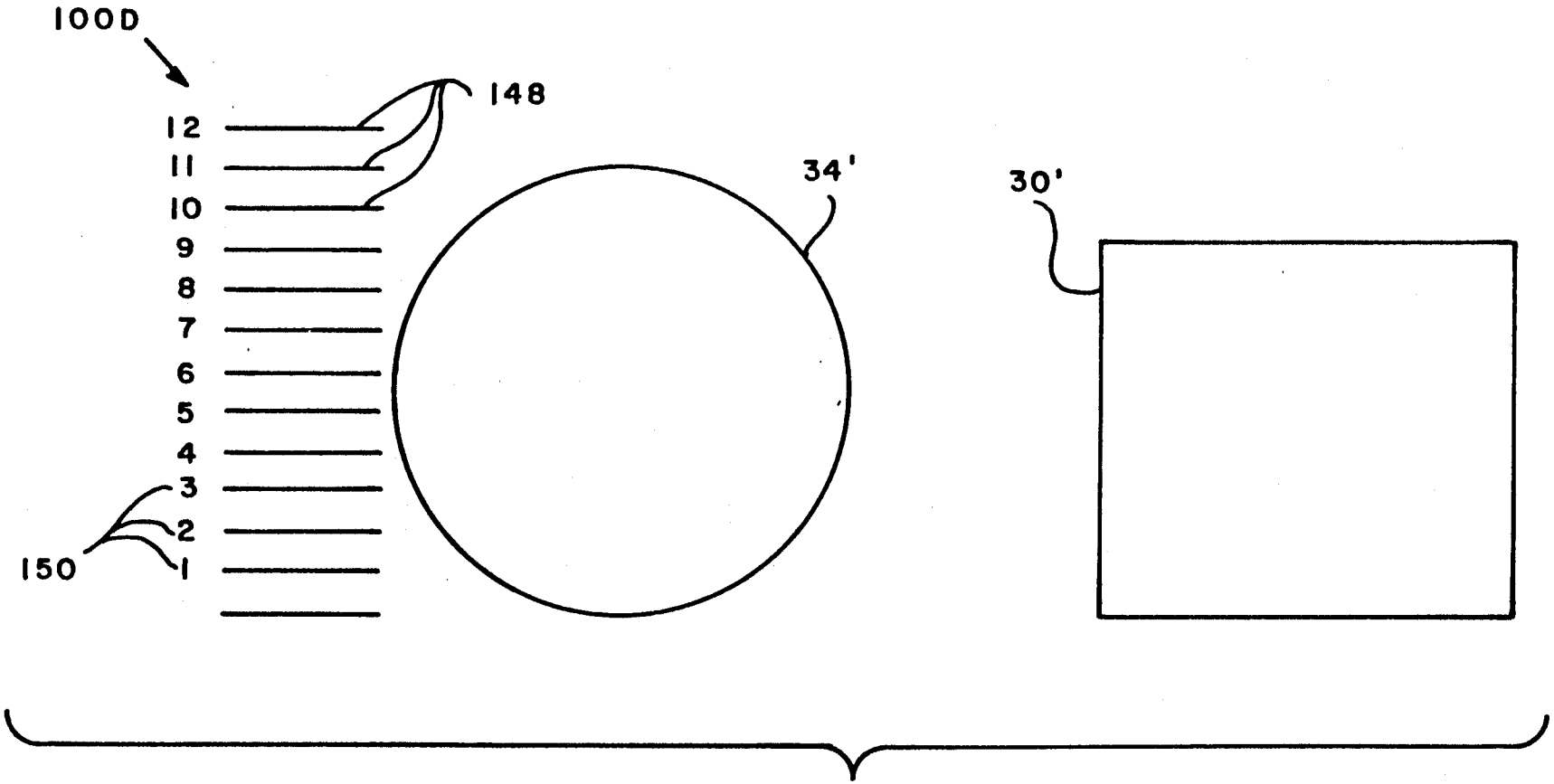
FIG. 4-B

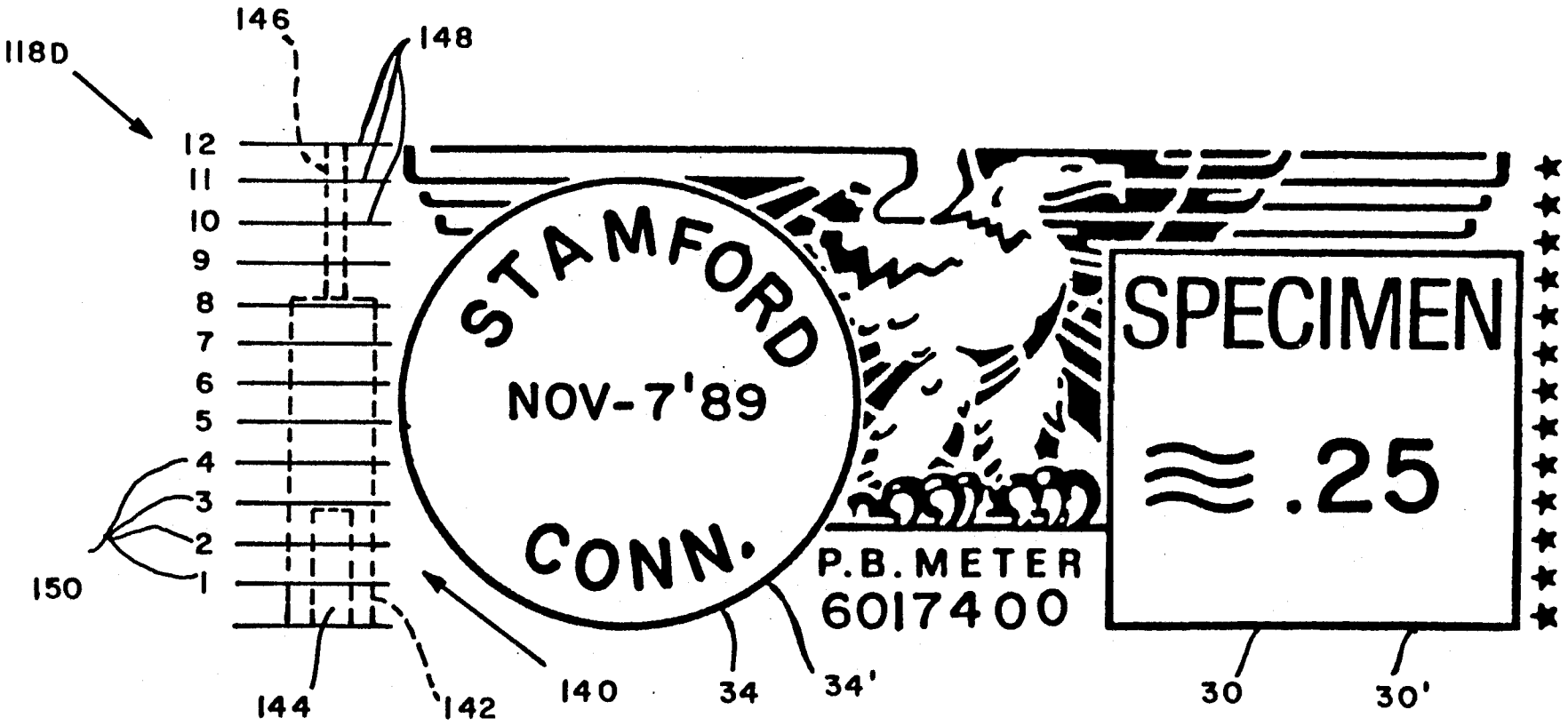
FIG. 4-C

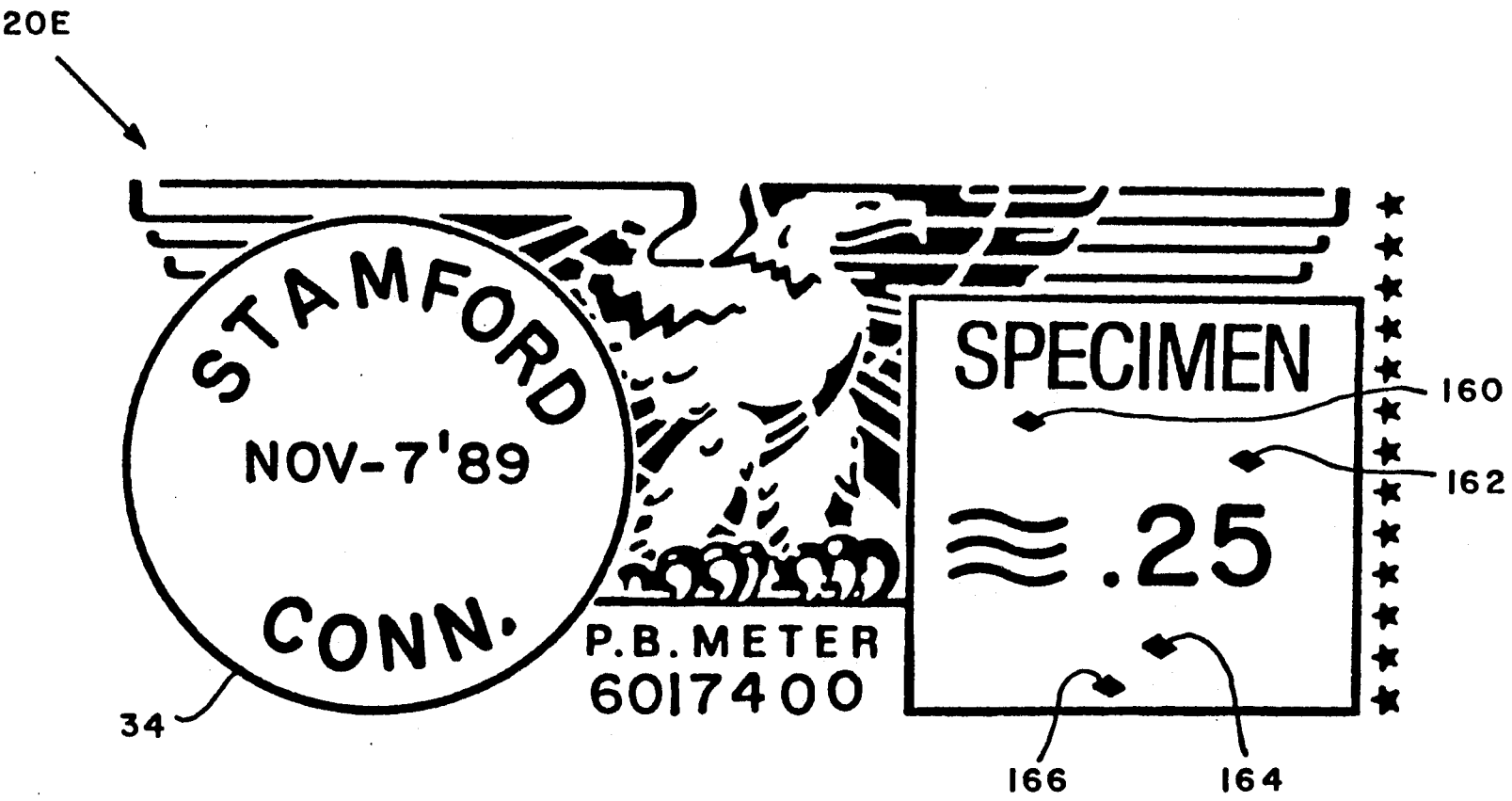
FIG. 5-A

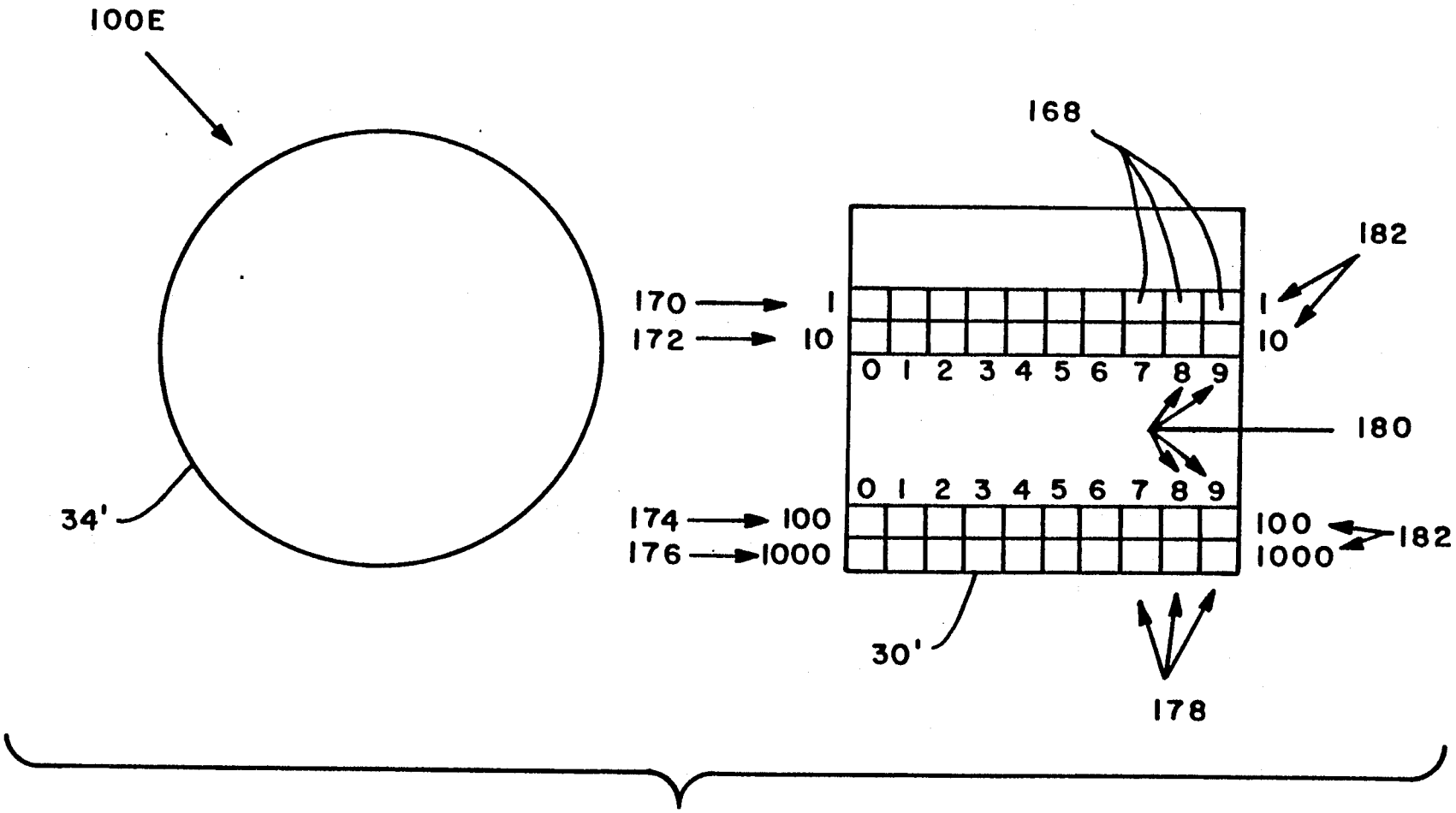
FIG. 5-B

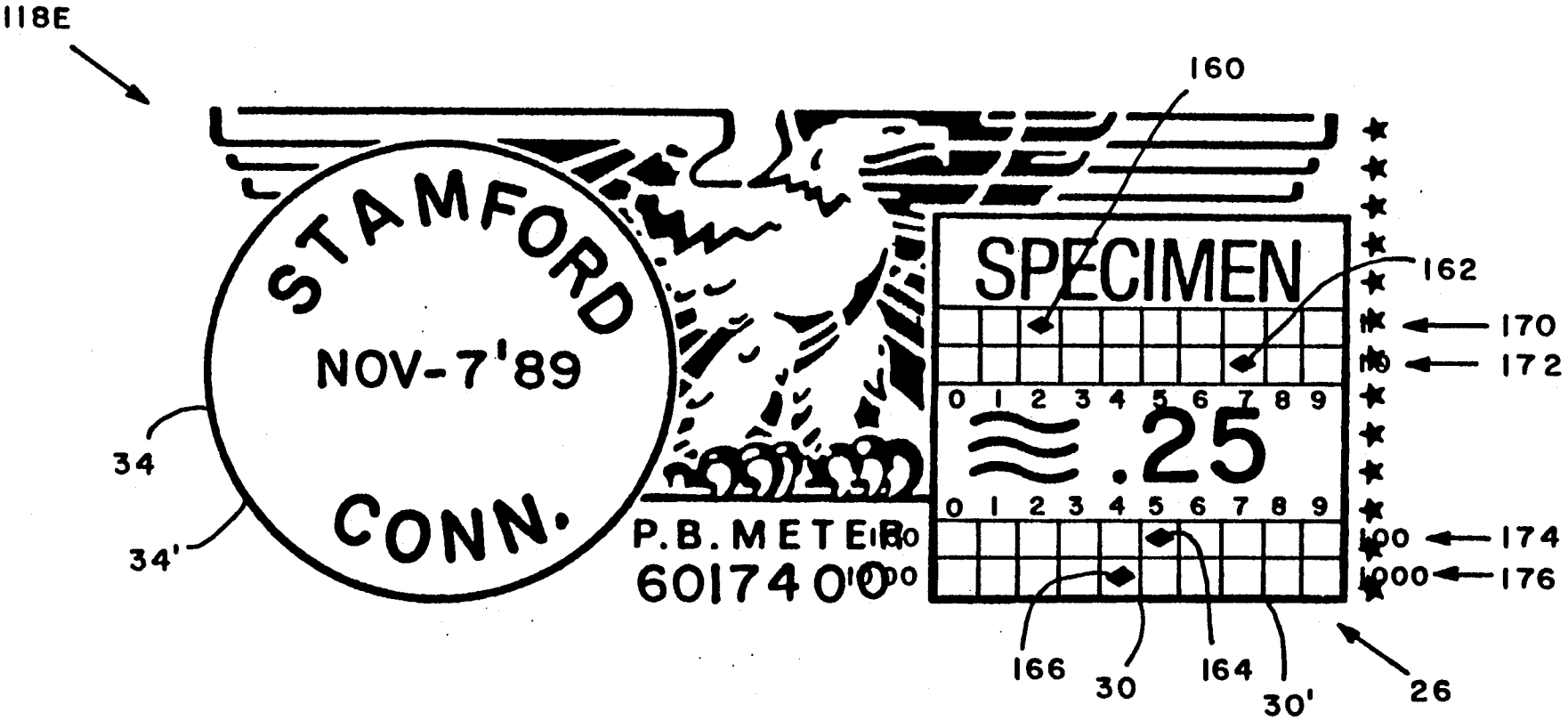
FIG. 5-C

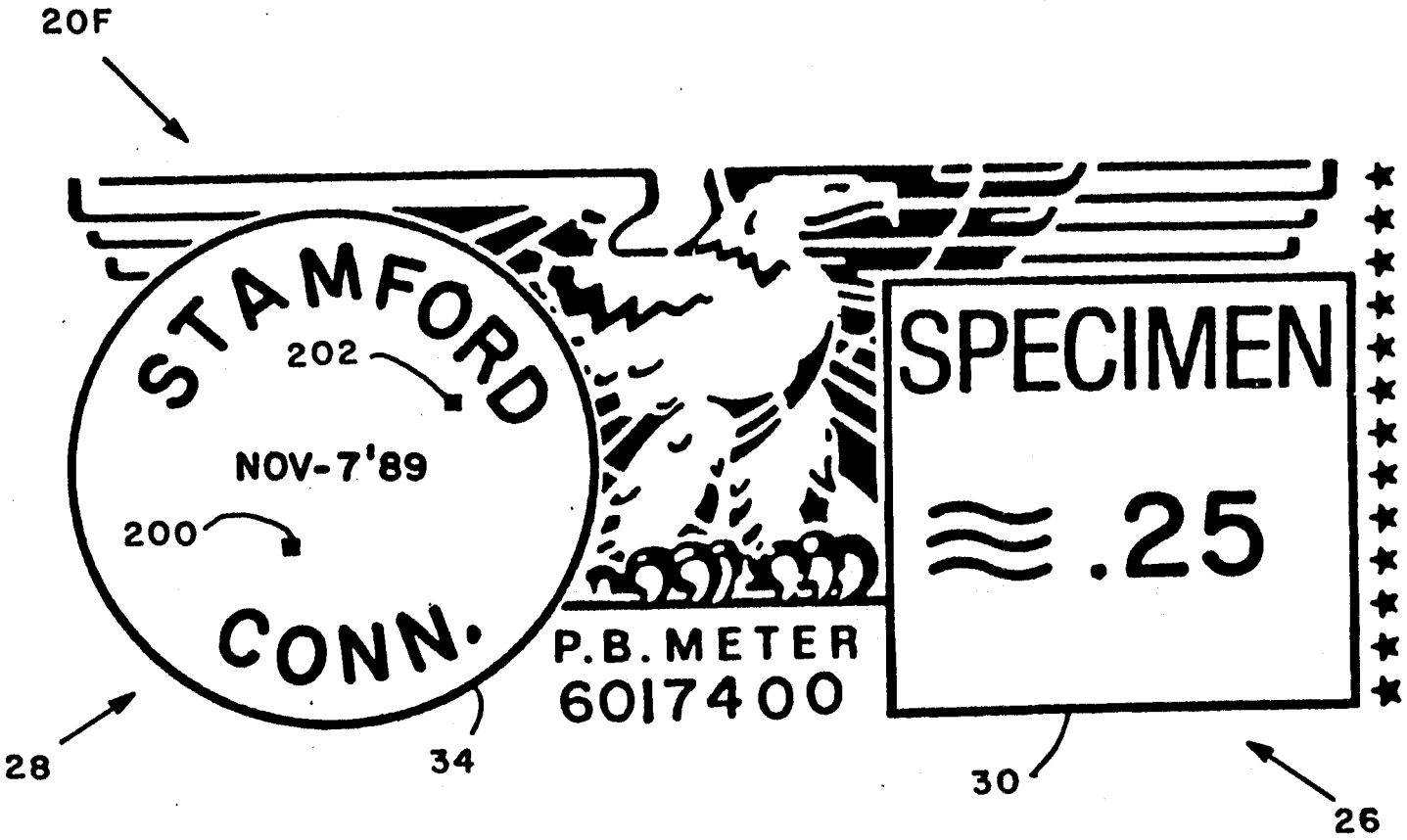
FIG. 6-A

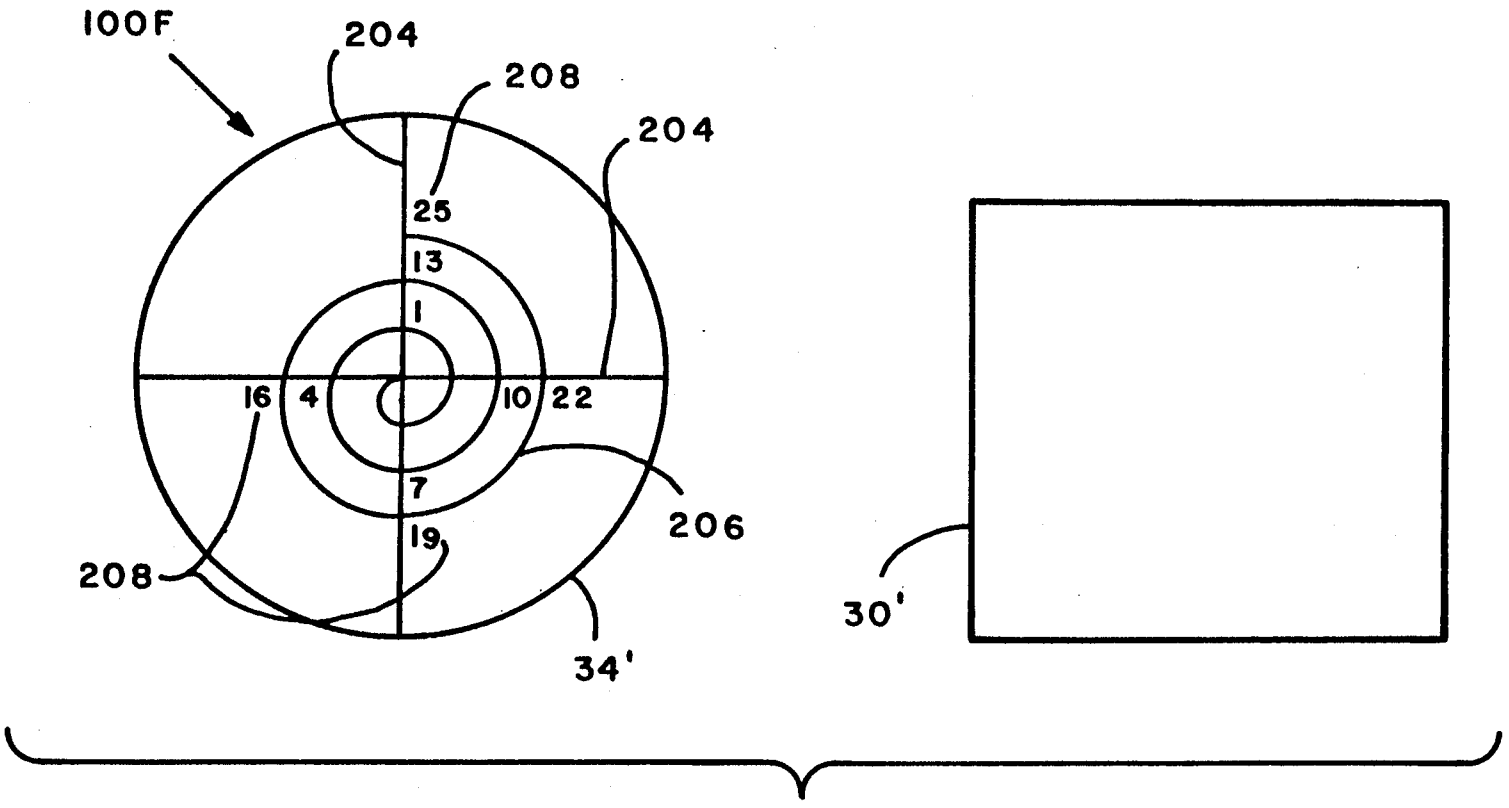
FIG. 6-B

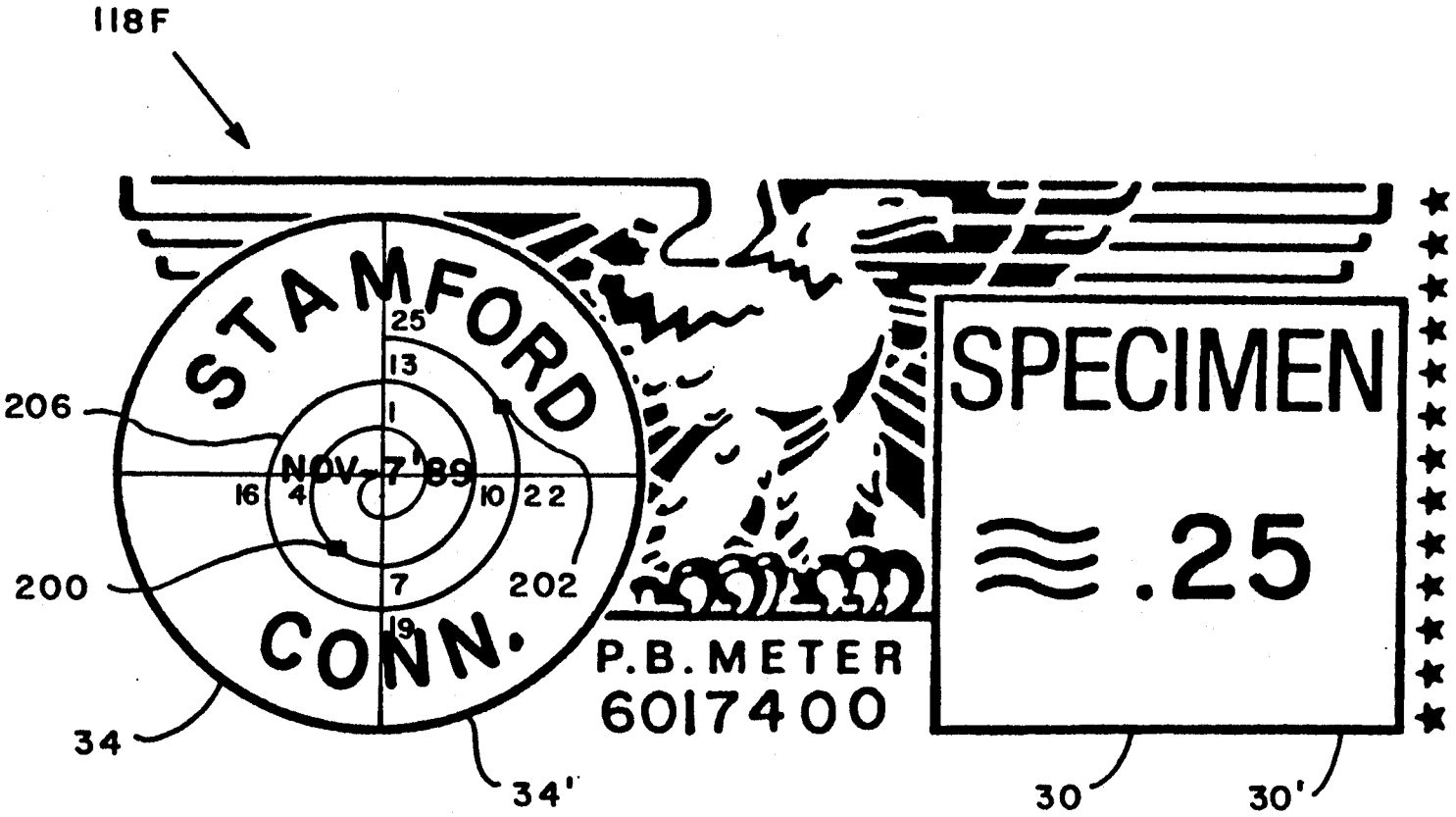
FIG. 6-C

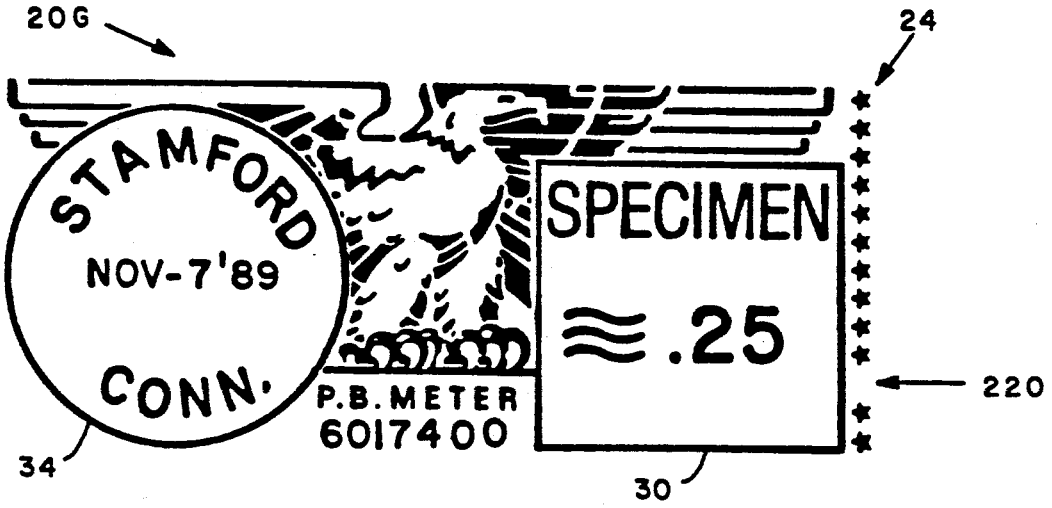
FIG. 7-A
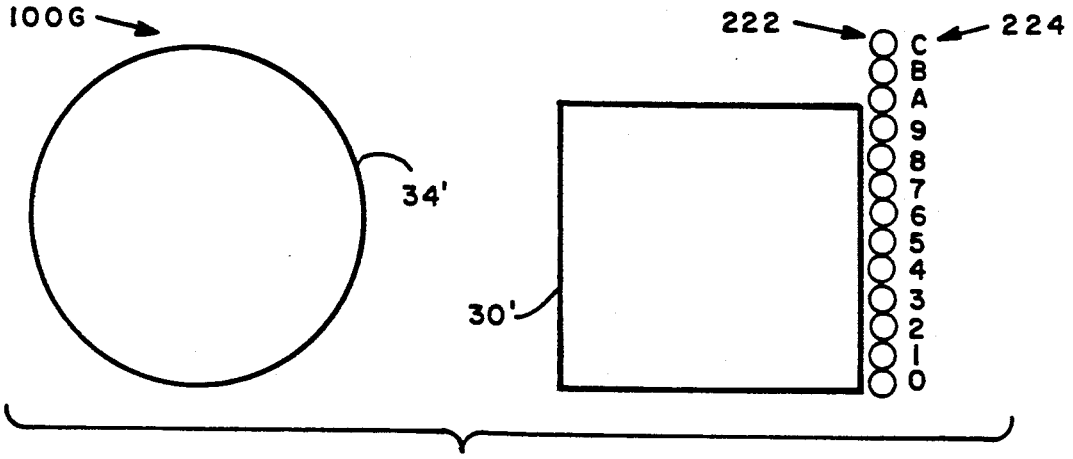
FIG. 7-B
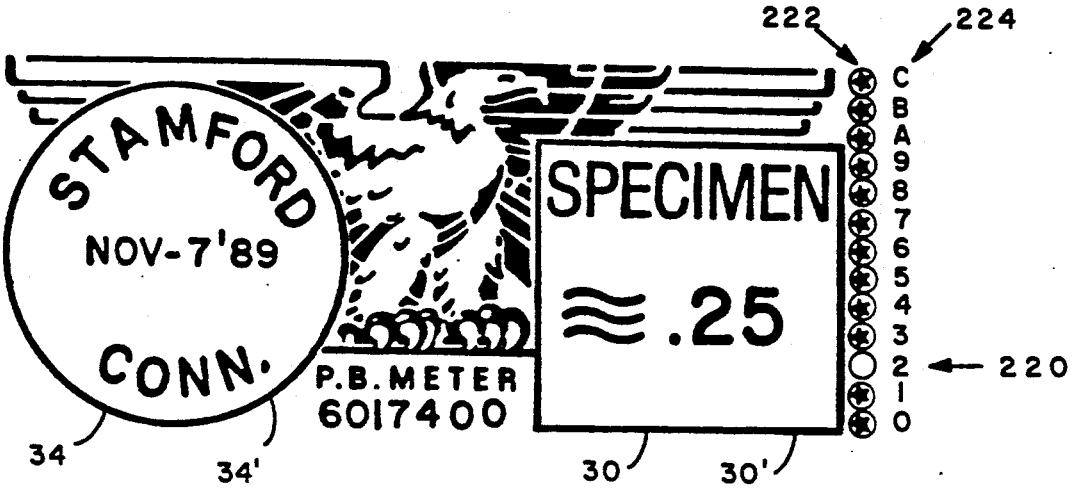
FIG. 7-C

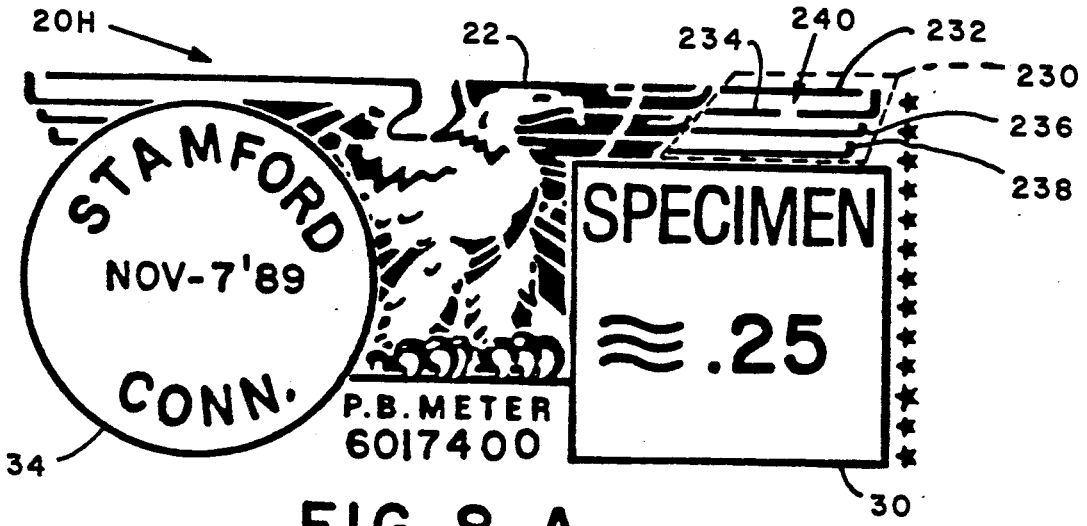
FIG. 8-A
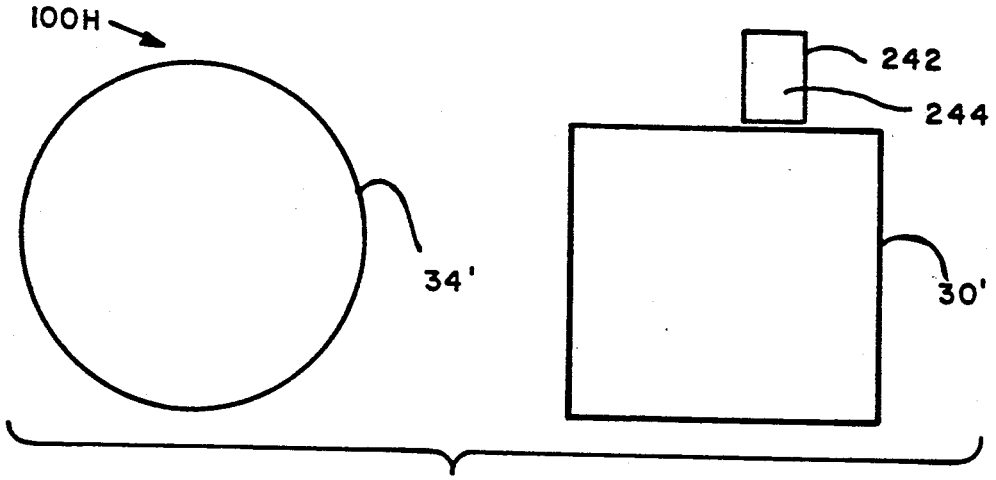
FIG. 8-B
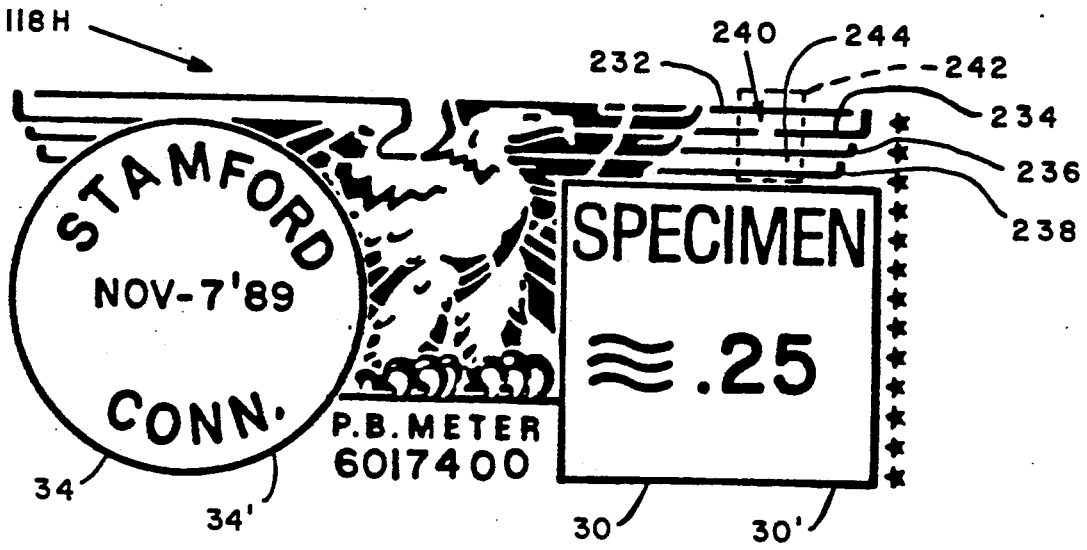
FIG. 8-C

SYSTEM FOR PRINTING VALUE INDICIA WITH DIAGRAMMATIC DATA REPRESENTATION

FIELD OF THE INVENTION

This invention relates to postage meters and other value printing systems, and particularly to an improved method of presenting data in the indicia printed by such systems.

BACKGROUND OF THE INVENTION

Postage meters and other value printing devices (e.g. parcel registers, tax stamp meters, encrypted indicia printing systems, etc.) print indicia that represent monetary values. A prime concern in the design of such devices is security of the revenues represented by the indicia. Revenue security has also been a major consideration in the design of the indicia itself. From the beginning, information contained in the indicia has been used for the purpose of verifying validity of the indicia, preventing counterfeiting or misuse, and so forth.

A specimen postage meter indicia according to prior art is shown in FIG. 1. The indicia, generally indicated by reference numeral 20, includes an ornamental portion 22 in the form of an American eagle, a column of stars 24, comprising thirteen stars, a postage amount field 26 and a postmark field 28.

Box 30 defines the boundary of postage amount field 26. Postage amount field 26 includes a printed postage amount 32. It will be appreciated that the legend "SPECIMEN" as shown within postage amount field 26 of specimen indicia 20 is, in actual practice, replaced by a legend such as "U.S. POSTAGE".

Ring 34 defines the boundary of postmark field 28. Postmark field 28 includes origin city designation 36, origin state designation 38 and date 40. In practice postmark field 28 often includes an origin zip code designation in addition to or instead of city designation 36 and state designation 38.

Indicia 20 also includes a meter serial number 42.

As is well known to those skilled in the art, indicia 20 is commonly produced by a rotary or flat-bed printing mechanism using a metal die. For any given die, indicia 20 is invariant except for date 40 and postage amount 32. Under postal regulations, date 40 is to be reset each day so that indicia 20 reflects the date on which the mailpiece is to be submitted to the Postal Service. Postage amount 32 also will vary, the amount depending on the weight, class of service, applicable discounts and other characteristics of the mailpiece to which the indicia is applied. Standard postage meters include means for changing the settings of date 40 and postage amount 32 and also means for accounting for each postage amount 32 that is included in an indicia. The invariant elements of indicia 20, being those other than date 40 and postage amount 32, will sometimes be referred to as the "fixed elements" of indicia 20.

The significance in terms of revenue security of the elements of indicia 20 are well known to those skilled in the art and so will not be discussed in detail. However, it should be noted that some portions of the fixed elements of indicia 20 are specifically designed to make difficult the counterfeiting of indicia 20. Those portions, which are difficult to accurately reproduce by unauthorized means, are referred to as "tells".

With the advent of microprocessors and of dot matrix printers such as ink jet, LED, thermal head or dot matrix pin printers, systems were developed to include in value indicia variable information in addition to date and monetary amount. For the most part the additional information is intended to reinforce the revenue security of the value printing system.

For instance, U.S. Pat. No. 4,835,713 to Pastor (assigned to the assignee of this application), teaches means for defining validating information in terms of a dot matrix, for image transforming that matrix and then for printing the image-transformed dot matrix as part of the indicia. The '713 patent also teaches printing of an alphanumeric array, or a serialized bar code, corresponding to the image transformed matrix. In co-pending application of Pastor, Ser. No. 245,479, filed Sept. 19, 1988, now U.S. Pat. No. 4,949,381 (assigned to the assignee of this application), the image transformed matrix is printed in bit mapped form.

In U.S. Pat. Nos. 4,637,051, to Clark, 4,641,346 to Clark et al. 4,641,347 to Clark et al., 4,829,568 to Clark et al., and 4,660,221 to Dlugos (all of which are assigned to the assignee of this application) there is taught another apparatus for producing a coded indicia. In this device, the indicia is printed in human readable format, but the dots forming the indicia are modified by voids or displacements or the like in order to produce a coded message that is then decodable to ensure that the coded information is identical to the human readable information of the indicia. Printing the coded message in barcoded form is also taught by these patents. Unlike the present invention, these patents teach modification of, or displacement of dots relative to, variable alphanumeric characters of an indicia rather than modification of, or displacement of dots relative to, the fixed features of an indicia.

In U.S. Pat. Nos. 4,649,266 to Eckert, 4,757,537 to Edelmann, 4,775,246 to Edelmann et al., and 4,725,718 to Sansone and Fougere, and in copending application of Chrosny, Ser. No. 882,871, filed July 7, 1986 (all assigned to the assignee of the present application), the indicia includes encrypted validation information in the form of alphanumeric characters. Copending application of Pastor, Ser. No. 515,531, filed May 29, 1990 (continuation of Ser. No. 245,611, filed Sept. 19, 1988) now U.S. Pat. No. 5,031,215, and assigned to the assignee hereof, discloses numeric characters for presenting encrypted validation information in an indicia.

Copending application of Connell et al., Ser. No. 074,424, filed July 16, 1987, and assigned to the assignee of the present application, now U.S. Pat. No. 4,933,849, teaches selection of one indicia pattern from a plurality of indicia patterns for the purpose of authenticating the indicia.

Copending application of Sansone, Ser. No. 904,522, filed Sept. 5, 1986, and assigned to the assignee of this application, teaches printing of a postage indicia by a dot matrix printer using non-standard print quality to deter attachment of unauthorized printers. In another embodiment, the background of the indicia changes in terms of density as a batch of mail is processed. The disclosure of said application Ser. No. 904,522 is hereby incorporated by reference into this application.

Also to be noted are U.S. Pat. Nos. 3,869,986, to Hubbard and 3,990,362 to Check et al., both assigned to the assignee of this application, in which a conventional postage meter printing mechanism is combined with an ink jet printer or other computer output printer Another security feature that is relevant to the present application is disclosed in U.S. Pat. No. 4,812,994, to Taylor et al., which is assigned to the assignee of this application. The '994 patent teaches a postage metering system that includes a time-of-day clock. A suitable program allows time limits to be selected such that the metering system is inoperable except during times that are within the selected time limits. The disclosure of the '994 patent is hereby incorporated by reference into this application.

SUMMARY OF THE INVENTION

In accordance with the present invention there is disclosed a value indicia that includes variable information and/or validation markings in an especially convenient form. A value printing system that prints such a value indicia includes means for printing the indicia, means for controlling the printing means and means for accounting for the value represented by the indicia. The control means controls the printing means to print an indicia that includes numerical information represented in diagrammatic form. "Representation in diagrammatic form" means representation of numerical information by selected characteristics and/or spacial relationships of graphical elements of an indicia. Such characteristics and relationships include size, shape, length, orientation and/or position relative to fixed elements of the indicia of markers such as dots, bars, lines and the like, each marker representing a numeric value. "Representation in diagrammatic form" does not include printing of alphanumeric characters, bar codes or binary coded bit maps.

In one embodiment, the system includes a time of day clock and prints an indicia that includes a clock face image that represents the time of day at which the indicia was printed.

In another embodiment the diagrammatic form includes bar graphs.

Alternatively, or in addition to diagrammatic representation of numerical information, the indicia includes at least one tell location defined by position relative to fixed elements of the indicia. The presence or absence of a dot or other marker in the tell location authenticates the indicia.

According to another aspect of the invention, there is provided an overlay which has a pattern that aids in the interpretation of at least one marker contained in the indicia.

BRIEF DESCRIPTION OF THE DRAWINGS

FIG. 2-A is a flow chart of a program for operating the system of FIG. 2.

FIG. 3-A is an example of an indicia printed by the system of FIG. 2

FIG. 3-B is an overlay pattern for interpreting the indicia of FIG. 3-A.

FIG. 3-C is an image produced by superposing the pattern of FIG. 3-B on the indicia of FIG. 3-A.

FIGS. 3-D, 3-E are additional overlay patterns for use with the indicia of FIG. 3-A.

FIG. 3-F is an example of another indicia according to the invention.

FIG. 4-A is another example of an indicia according to the invention.

FIG. 4-B is an overlay pattern useful with the indicia of FIG. 4-A.

FIG. 4-C is an image produced by superposing the pattern of FIG. 4-B on the indicia of FIG. 4-A.

FIG. 5-A is another example of an indicia according to the invention.

FIG. 5-B is an overlay pattern useful with the indicia of FIG. 5-A.

FIG. 5-C is an image produced by superposing the pattern of FIG. 5-B on the indicia of FIG. 5-A.

FIG. 6-A is another example of an indicia according to the invention.

FIG. 6-B is an overlay pattern useful with the indicia of FIG. 6-A.

FIG. 6-C is an image produced by superposing the pattern of FIG. 6-B on the indicia of FIG. 6-A.

FIG. 7-A is another example of an indicia according to the invention.

FIG. 7-B is an overlay pattern useful with the indicia of FIG. 7-A.

FIG. 7-C is an image produced by superposing the pattern of FIG. 7-B on the indicia of FIG. 7-A.

FIG. 8-A is another example of an indicia according to the invention.

FIG. 8-B is an overlay pattern useful with the indicia of FIG. 8-A.

FIG. 8-C is an image produced by superposing the pattern of FIG. 8-B on the indicia of FIG. 8-A.

DETAILED DESCRIPTION OF THE PREFERRED EMBODIMENTS

Figure 2:
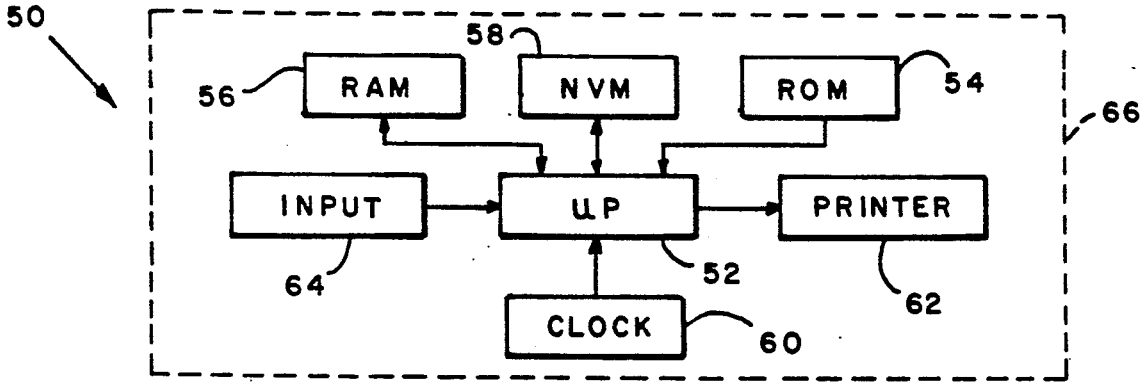
FIG. 2 is a block diagram of a value printing system according to the invention.
Figure 2A:
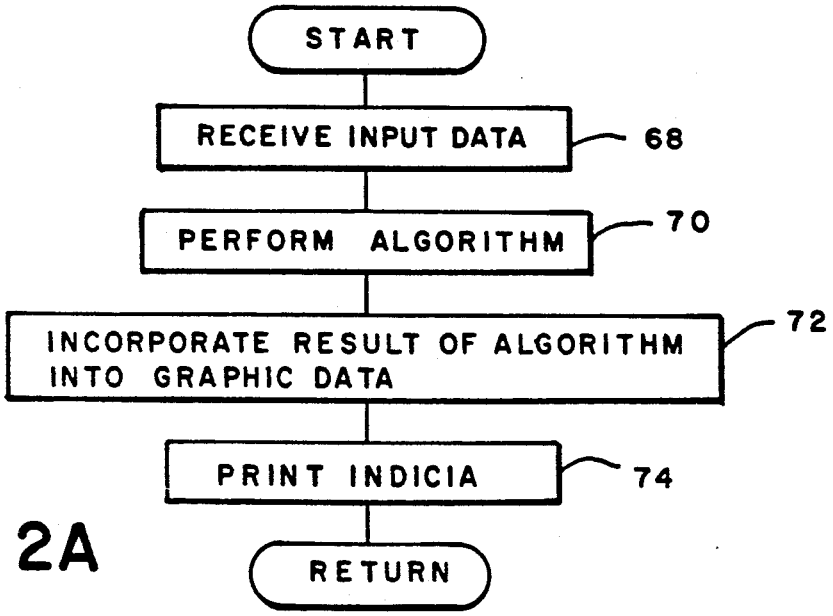

In accordance with the invention, FIG. 2 shows a block diagram of value printing system 50. Value printing system 50 includes microprocessor 52, which may be a model 8085 available from Intel Corporation, Santa Clara CA. ROM 54 stores a program for controlling microprocessor 52 and is accessible thereby for read operations. RAM 56 is used for temporary data storage and is accessible by microprocessor 52 for read or write operations.

Nonvolatile memory 58 is also accessible by microprocessor 52 for read or write operations and is used to store value accounting data. Nonvolatile memory 58 may be a EEPROM, a battery backed-up RAM or any other nonvolatile type of read/write memory. Clock module 60 provides microprocessor 52 with a signal representative of the time of day.

Printer 62 operates under the control of microprocessor 52 and prints indicia in accordance with data output by microprocessor 52. Printer 62 may be a laser, ink jet, LED, thermal head or dot matrix pin printer or any other printer that prints characters and images dot by dot. For example, printer 62 may be an HP Laserjet series II laser printer, available from Hewlett-Packard Co., Palo Alto Calif.

Input means 64 may be a keyboard, an electronic scale, a host computer or any other source of input data, based upon which microprocessor 52 causes printer 62 to print an indicia. Value printing system 50, may be wholly or partially within physically secure housing 66, or alternatively may be embodied in separate unsecured modules.

FIG. 2-A illustrates a procedure by which system 50 may be operated to print an indicia in accordance with the present invention. At step 68, microprocessor 52 receives input data. The input data may include a time of day signal from clock module 60, stored information representing month of inspection, and/or data representing the date on which the indicia is printed, postage amount, serial number, etc.

At step 70, microprocessor 52 performs an algorithm, such as that discussed below in connection with FIG. 9, and obtains a result. Alternatively, as in the case of the clock image of FIGS. 3-A, 3-B, 3-C, no algorithm may be required to be applied to the input data.

At step 72, microprocessor 52 incorporates the result of the algorithm (or the input data itself, if no algorithm is applied) into the graphic data which will be used to generate the indicia. At step 74, microprocessor 52 outputs the graphic data to the printer, causing the indicia to be printed.

Many variations upon the system of FIG. 2 and the procedure of FIG. 2-A are possible without departing from the scope of the invention. Further, it is also within the contemplation of the invention to produce indicia such as those discussed below by use of electromechanical printing means or a printer combining electromechanical and dot matrix means.

Figure 1:
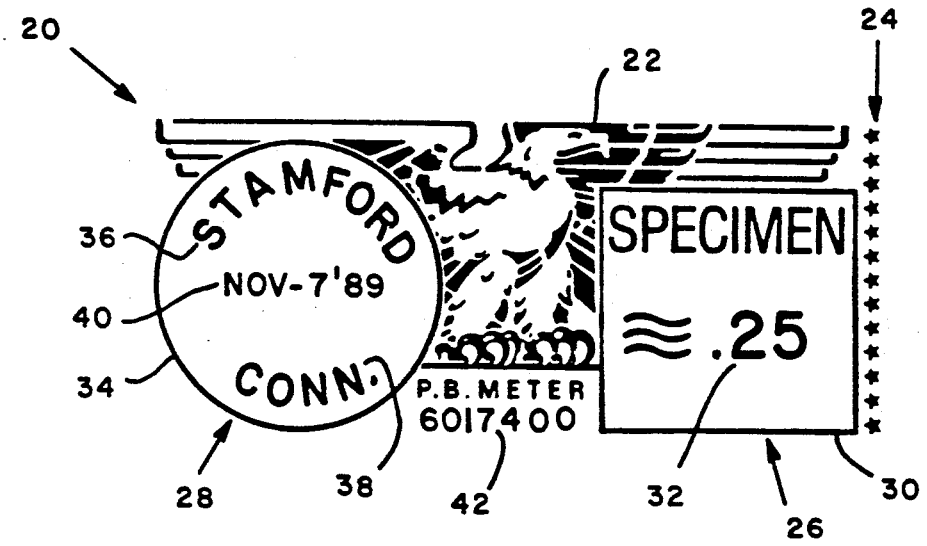
FIG. 1 (PRIOR ART)
FIG. 1 is a postage meter indicia according to prior art.

Referring to FIG. 3-A, reference character 20A generally indicates an indicia printed by value printing system 50. Indicia 20A comprises all of the features of indicia 20 of FIG. 1. In addition, indicia 20A comprises small dot 80, large dot 82, and diamond shaped marker 84. (Dots 80, 82 and marker 84 will sometimes be collectively referred to as "markers".) Markers 80, 82, 84 are all located within, ring 34 of indicia 20A.

FIG. 3-B shows overlay pattern 100A, which comprises ring 34' and box 30'. Ring 34' and box 30' are, respectively, the same size and shape as ring 34 and box 30 of indicia 20A and are in the same relative position to each other as ring 34 and box 30.

Circles 102, 104, 106 are concentrically arranged within ring 34' and respectively mark the inner boundaries of zones 112, 114, 116. Ring 34' and circles 102 and 104 respectively mark the outer boundaries of zones 112, 114, 116.

It will be appreciated that pattern 100A may be printed on a transparent sheet so as to form an overlay. On such an overlay zones 112, 114, 116 may each be distinguished from each other and from adjoining areas by use of appropriate tinting, coloring and/or shading, in addition to, or instead of, circles 102, 104, 106. Such an overlay may be superposed upon indicia 20A so that ring 34' coincides with ring 34 and box 30' coincides with box 30, producing image 118A as shown in FIG. 3-C. It will be noted that small dot 80 falls within zone 114, large dot 82 within zone 116 and marker 84 within zone 112. If zone 114 is considered to represent minutes, zone 116 hours and zone 112 months, markers 80, 82, 84 may be read as an image of a minute/hour/month clock. Thus the clock image shown by FIGS. 3-A and 3-C may be interpreted as showing that indicia 20A was printed at 3:00 o'clock and that the latest inspection of value printing system occurred in August (or the next inspection is due next August).

It will be understood that markers 80, 82, 84 are variable elements of indicia 20A. Microprocessor 52, operating under the control of an appropriate program stored in ROM 54, controls printer 62 to print dots 80, 82 in positions determined in accordance with a time of day signal provided by clock 60. Similarly, the position of marker 84 depends on inspection date data stored in nonvolatile memory 58.

As will be appreciated by those skilled in the art, representation in the indicia of the time of printing provides a number of advantages. For example, in a mail room that operates from 9:00 a.m. to 5:00 p.m., an indicia printed at 7:00 would be readily detectable as the work of an unauthorized person. As another example, a mail processing operation that delivers to the post office several batches of mail each day could use the time markings to determine how much sooner the post office delivers the earlier batches of mail, or whether the post office is meeting its delivery standards.

Another advantage would be realized in a value printing system for processing batches of mail, such as that described in aforementioned application Ser. No. 904,522. In a batch mailing in which each piece bears a clock image, postal authorities could "riffle" through the mailing to confirm that the time indicated by the clock image advances throughout the mailing, thus helping to verify that the mailing was properly prepared, and was not "salted" with unauthorized pieces that were prepared before or after the mailing itself.

Further, if it were desired to serialize the mail pieces, a relatively small number of digits would be required in the serial number, since two pieces printed at least 15 minutes apart (or less) could be readily distinguished from each other by the different clock images contained in their respective indicias.

Representation of the latest, or next scheduled, inspection date is advantageous for revenue security. For instance, the date indicated by the indicia may be checked against the postal service's records. Alternatively, microprocessor 52 may be programmed to omit printing of marker 84 if the date for inspection has passed and inspection has not occurred. In that case, lack of a marker 84 would be an indication that inspection is past due.

It will be noted that the addition of markers 80, 82, 84 does not cause the overall appearance of indicia 20A to differ greatly from the appearance of prior art indicia 20. The diagrammatic representation of the time of day and date of inspection makes efficient use of the space occupied by indicia 20A and does not cause indicia 20A to appear cluttered.

Although three different markers are shown in indicia 20A (small dot 80, large dot 82, diamond shaped marker 84), it will be appreciated that a single type of marker with a uniform size and shape may be used, in which case the position alone will be used to determine what type of data each marker indicates In such a case, use of an overlay may be advisable. However, given the types of markers shown in FIG. 3-A, an overlay may not be required for many purposes; for example, the clock image conveyed by dots 80, 82 can be read rather easily without an overlay.

Reading of the clock image ma be further facilitated by shifting the "hour" marker as the "minute" marker progresses, as occurs with an analog clock. In this case, for example, if the indicia of FIGS. 3-A, 3-C were printed at 3:30, dot 82 would be printed at a position shifted 15° clockwise in zone 116, relative to its position shown in the 3:00 image of FIGS. 3-A, 3-C.

If it is desired to distinguish between representations of a.m. and p.m. printing times, the size and/or shape of markers 80, 82 (and possibly 84 as well) may be varied so that, for instance, round markers indicate a.m. while diamond shaped markers indicate p.m.. Alternatively, a location may be defined in which the presence of a marker indicates a.m. and the absence thereof indicates p.m. (or vice versa). As still other alternatives, zone 116 can be divided into 24 segments, each corresponding to an hour of the day, or two zones of twelve segments each may be used to represent hours.

It will be noted that use of different shaped and/or sized markers is possible in a single zone, with each marker carrying a different meaning. When the two markers happen to coincide, the smaller may be represented as a negative image against the background of the larger.

It will further be appreciated that a wide variety of combinations of markers may be used, the markers being of various sizes, shapes, and/or orientations.

A variety of different overlay patterns may also be useful. For example, overlay pattern 100B, as shown in FIG. 3-D, includes quarter marks 120 which aid in distinguishing the exact positions of markers. In another embodiment as shown on FIG. 3-E, overlay pattern 100C includes dividing lines 122, and segment identifying numerals 124, which identify the twelve segments 126 divided from each other by dividing lines 122. By reference to segments 126 and zones 112, 114, 116, markers 80, 82, 84 may be interpreted to represent a three-digit duodecimal number. If zone 112 is defined to represent units, zone 114 to represent twelves, and zone 116 to represent 144's then markers 80, 82, 84, as shown in FIG. 3-C, represent the number 308 (base 12).

It should be understood that overlay pattern 100C could have ten segments (or some other number of segments) instead of twelve, and that the number of zones could be increased or decreased. Thus a multidigit decimal number could be represented by markers located in circular zones within postmark field 28.

For any of the overlay patterns illustrated or discussed herein, it is advantageous that the same be printed on the overlay in a color, advantageously a pastel, that contrasts with the ink used for printing indicia 20A and, at the same time, allows the user to discern indicia 20A through the printed portions of the overlay as well as the clear portions.

In the event that a marker coincides with one or more of the alphanumeric characters present in field 28, it may be acceptable simply to print the marker over the character. Alternatively, those coinciding characters may be printed in negative (i.e. white against a dark background) to the extent that the marker is printed over the characters. Referring to FIG. 3-F, marker 84 coincides with letter "M" of city designation 36. It will be noted that letter "M" is printed in negative to the extent that marker 84 is printed over it.

FIGS. 4-A, 4-B, 4-C illustrate another diagrammatic form in which an indicia may include numerical data according to this invention. In FIG. 4-A, indicia 20D includes bargraph 140. Bargraph 140 comprises wide bar 142, moderate-width bar 144 and narrow bar 146. Bar 142 is approximately twice as wide as bar 144, which is approximately twice as wide as bar 146.

FIG. 4-B shows overlay pattern 100D, which comprises measuring lines 148 and identifying numerals 150. As before ring 34' and box 30' of pattern 100D correspond to ring 34 and box 30 of indicia 20D.

FIG. 4-C shows image 118D produced by superposing pattern 100D upon indicia 20D. For purposes of illustration, bargraph 140 is shown in phantom in FIG. 4-C although it will be understood that in an actual image 118D bargraph 140 would have the appearance of bargraph 140 in FIG. 4-A. As before overlay pattern 100D is printed in a color that both contrasts with indicia 20D and allows indicia 20D to be discerned through such printing. If bar 142 represents the last, or next scheduled, inspection date, and bars 144, 146 respectively represent hours and minutes of the time of printing, by referring to lines 148 and numerals 150 it can be be seen that bargraph 140 represents the same data as markers 80, 82, 84 of FIG. 3-A. That is, the time of printing was 3:00 o'clock and the inspection date is August.

When a bar does not extend beyond a wider bar, it will be seen that the narrow bar may be printed as a contrasting image against the background of the wider bar. See, e.g. bar 144 which appears as a negative image against bar 142. Bar 146 represents the value '12' and thus extends beyond bars 142, 144, but if bar 146 had been required to represent the value '1', '2' or '3', it would have been printed as a dark image against the light background of ba 144. If bar 146 had been required to represent the value '4', '5', '6', '7' or '8' it would have been printed as a light image against the dark background of bar 142.

As was noted with respect to markers 80, 82, 84, bargraph 140 may be used to represent numerical data other than time of printing and inspection date. By use of an appropriate overlay, and by adding additional bars if desired, it is possible for bargraph 140 to represent a multidigit number in a decimal or other number system.

FIGS. 5-A, 5-B, 5-C illustrate another diagrammatic form in which an indicia may present numerical data in accordance with this invention. Indicia 20E (FIG. 5-A) includes markers 160, 162, 164, 166.

FIG. 5-B shows overlay pattern 100E, in which, as before, ring 34' and box 30' correspond respectively to ring 34 and box 30 of indicia 20E. Pattern 100E further comprises forty zones 168, arranged in four rows 170, 172, 174, 176 and ten columns 178, each zone 118 being the intersection of a row and a column 178. Associated with each column 178 is a column numeral 180, and associated with each row is a row value identifier 182. For ease of reading, column numerals 180 and value identifiers 182 are positioned in duplicate adjacent their respective rows and columns.

Image 118E (FIG. 5-C) is produced by superposing overlay pattern 100E over indicia 20E. It will be observed that marker 160 is in the zone defined by row 170 and the column associated with the numeral '2', marker 162 is in the zone defined by row 172 and the column associated with the numeral '7', marker 164 is in the zone defined by row 174 and the column associated with the numeral '5', and marker 166 is in the zone defined by row 176 and the column associated with the numeral '4'. Markers 160, 162, 164, 166 can be read as representing a four digit decimal number: 2754. It will be appreciated that any four digit decimal number can be represented by printing four markers in postage amount field 26 so that one marker falls in the appropriate zone of each of the four rows 170, 172, 174, 176.

Image 118E also illustrates an indicia verification scheme in which: (a) the marker printed in row 170 represents the sum modulo ten of the least significant digits of the date and the postage amount; (b) the marker printed in row 172 represents the sum modulo ten of the least significant digits of the date and the meter serial number; (c) the marker printed in row 174 represents the sum modulo ten of the last significant digits of the postage amount and the meter serial number; (d) the marker printed in row 176 represents the sum modulo ten of the three numbers represented by the other markers.

FIGS. 6-A, 6-B, 6-C illustrate yet another diagrammatic form in which an indicia may present numerical data in accordance with this invention. Indicia 20F (FIG. 6-A) includes markers 200, 202.

FIG. 6-B shows overlay pattern 100F, in which, as before, ring 34' and box 30' correspond respectively to ring 34 and box 30 of indicia 20F. Pattern 100F further comprises crossbars 204, spiral 206, and position identifiers 208.

Image 118F (FIG. 6-C) is produced by superposing overlay pattern 100F over indicia 20F. It will be observed that markers 200, 202, fall on spiral 206 in positions representing, respectively, '6' and '23'. It will be appreciated that by using pattern 100F and printing appropriate markers in postmark field 28, it is possible to represent encrypted numerical data generated by an encryption algorithm that produces a set of positive integers, each integer being less than or equal to 25 and no integer being included in the set more than once. The inputs to the encryption algorithm may include data related to the date or postage amount of the indicia, meter serial number, other information printed on the item bearing the indicia, a secret key number associated with the meter, and so forth.

FIGS. 7-A, 7-B, 7-C illustrate use of tell locations to authenticate an indicia. Indicia 20G (FIG. 7-A) includes column of stars 24. If indicia 20G, and specifically location 220 thereof, is compared with indicia 20 of FIG. 1, it will be observed that a star included in column 24 of indicia 20 is omitted from column 24 of indicia 20G.

FIG. 7-B shows overlay pattern 100G. Again, pattern 100G has ring 34' and box 30' corresponding respectively to ring 34 and box 30 of indicia 20G. Pattern 100G also comprises column of circles 222 and column of identifying numerals 224 associated therewith.

Image 118G (FIG. 7-C) is produced by overlaying pattern 100G over indicia 20G. Each of the circles in column 224 may be considered to define a tell location of indicia 20G. It will be observed that each of the tell locations is occupied by a star except for that associated with identifying numeral '2', which location corresponds to location 220 of indicia 20G. The absence of a star at location 220 may be interpreted as authenticating indicia 20G in connection with a scheme in which the least significant digits of the date and postage amount are summed modulo ten and the star corresponding to that sum is then omitted.

As will be appreciated by those skilled in the art, many other authentication schemes are possible using the stars of column 24. For example, a modulo thirteen sum may be used in which case all thirteen tell locations defined by column 24 would come into use. Or, a second set of digits may be summed modulo three and the top three tell locations used. As another alternative, microprocessor 52 may be programmed so that a fixed number, for instance two, of the thirteen stars of column 24 are to be omitted from each indicia. The program would include a provision for randomly selecting for each indicia the two stars to be omitted, so that the two stars to be omitted would vary from indicia to indicia.

FIGS. 8-A, 8-B, 8-C illustrate another authentication scheme using tell locations. Referring to FIG. 8-A, ornamental portion 22 of indicia 20H has group 230 of generally horizontal bars 232, 234, 236, 238. It will be noted that there is a break 240 in bar 234.

In FIG. 8-B, overlay pattern 100H again has ring 34' and box 30' respectively corresponding to ring 34 and box 30 of indicia 20H. Pattern 100H also includes rectangle 242 which defines zone 244.

Image 118H (FIG. 8-C) is produced by superposing pattern 100H upon indicia 20H. Rectangle 242, shown in phantom, again defines zone 244. The portions of bars 232, 234, 236, 238 within zone 244 may be considered tell locations and break 240 may be considered a tell. Microprocessor 52 is programmed to randomly select one (or another fixed number) of the group 230 of bars to be broken at its tell location.

If it is desired to check the authenticity of a group of letters bearing indicias of the sort shown on FIG. 8-A, one examines the indicias to see that in each indicia the correct number of breaks are present in tell locations and that the specific tell locations in which the breaks are present vary from letter to letter. Alternatively, the bar or bars to be broken may be determined on the basis of an algorithm, of which the inputs may include date, postage amount, etc.

Figure 9:
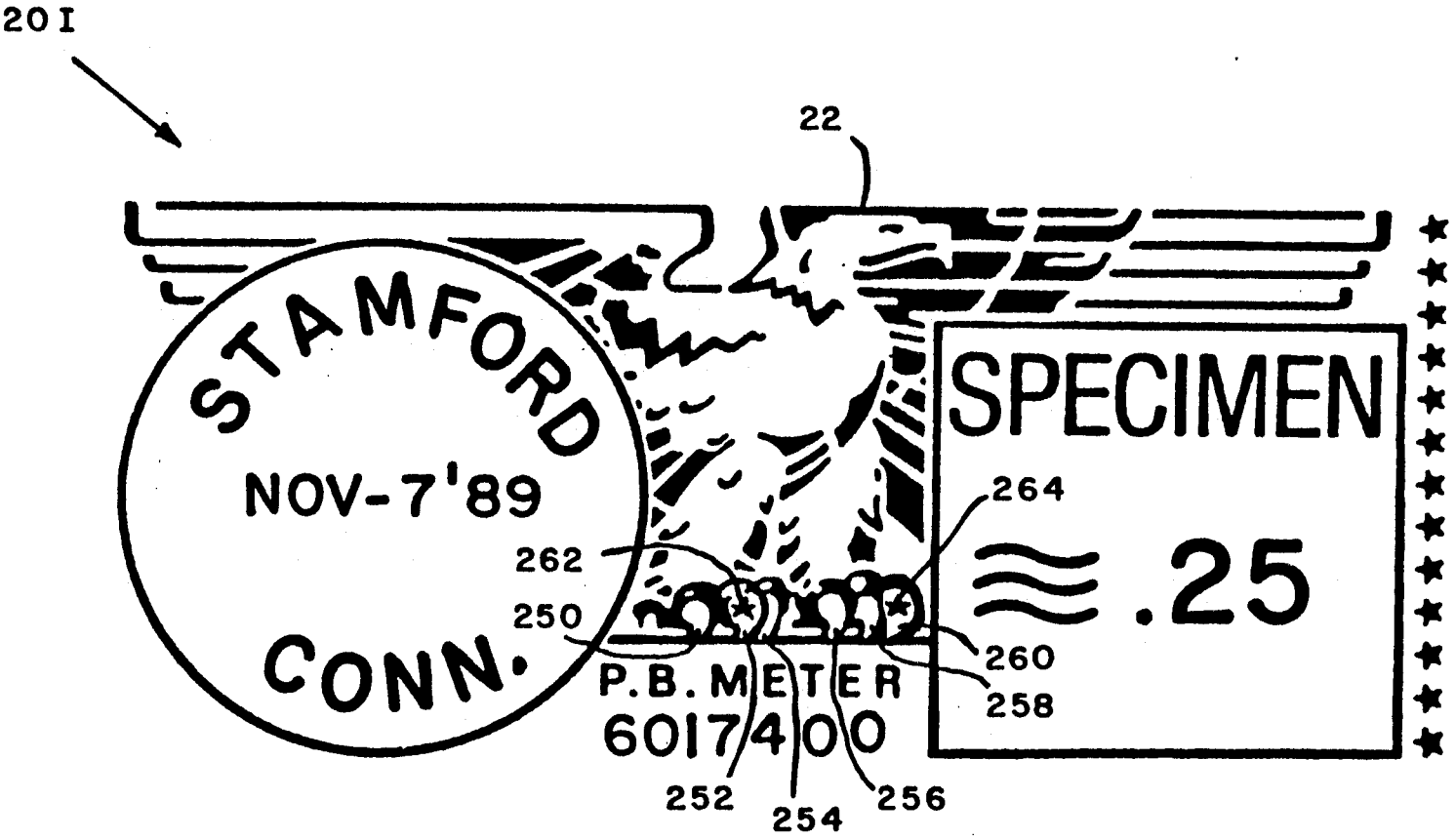
FIG. 9 is another example of an indicia according to the invention.

FIG. 9 illustrates yet another authentication scheme using tell locations. Indicia 20I includes ornamental portion 22 which comprises talons 250, 252, 254, 256, 258, 260. It will be appreciated that talons 250, 252, 254, 256, 258, 260 may be used as tell locations, in which markers may be printed or omitted. As shown in FIG. 9, markers 262, 264 are respectively located within talons 252, 260, and there are no markers within talons 250, 254, 256, 258. As with the broken bar tell location scheme of FIGS. 8-A, 8-B, 8-C, the talons within which markers are to be printed or omitted may be selected randomly within the constraints of certain rules or in accordance with an algorithm based on variable information in the indicia or meter identification or other information.

In the discussion of the embodiments described above, human reading of the indicia has been contemplated, often with the aid of an overlay. It is also within the contemplation of this invention that the indicia illustrated herein be read by a scanning device, that device being programmed to determine the position of the marker or markers relative to fixed elements of the indicia, the presence or absence of markers at fixed positions, and/or the size, shape or orientation of markers.

It should also be understood that a wide variety of overlay patterns may be used, such patterns containing one or more elements corresponding to fixed elements of the indicia. Those corresponding elements may, but need not, (7 include box 30' and ring 34' of the patterns shown in FIGS. 3-B, 4-B et al. Of course, the fixed elements of the indicia also may vary from those illustrated herein.

It is also within the contemplation of this invention, to print some or all markers in a different color of ink from the balance of the indicia.

It will further be understood that at least some of the numerical data representation schemes and the authentication schemes illustrated herein may be used together in a single indicia. For example, the circular tracks of FIGS. 3-A, 3-B, 3-C, used with a ten segment overlay pattern, can be combined with the bargraph of FIG. 4-A, used with a decimal overlay, and with the scheme of FIGS. 5-A, 5-B, 5-C. It will be appreciated that a combination of these three schemes can be used to present a ten digit decimal number in diagrammatic form. An eleventh digit could be represented by use of the tell locations of FIGS. 7-A, 7-B, 7-C. As will be appreciated by those skilled in the art, many other combinations of numerical data representation and authentication schemes are possible. It will further be appreciated that the data representation and authentication schemes are illustrations of many schemes and variations thereof which are within the scope of this invention, and accordingly limitations of the subject invention are to be found only in the claims set forth below.

What is claimed is:

1. A value printing system, comprising:

(a) printing means for printing an indicia, said indicia representing a value;

(b) control means for controlling said printing means; and (c) means for accounting for said value represented by said indicia;

said control means controlling said printing means to print said indicia so that said indicia contains numerical information, said numerical information being represented in diagrammatic form and representing a single numerical value.

2. The system of claim 1, wherein said diagrammatic form comprises a bargraph.

3. The system of claim 1, wherein said diagrammatic form comprises at least one marker that occupies a location associated with a numeric value.

4. The system of claim 1, further comprising a clock module for providing a time of day signal to said control means, and wherein said numerical information comprises the time or printing of said indicia.

5. The system of claim 4, wherein said diagrammatic form comprises a clock image which represents said time of printing.

6. An overlay for interpreting an indicia having fixed elements, the overlay comprising:

(a) a transparent sheet; and (b) a pattern borne by said sheet, said pattern including at least one element matching at least one of said fixed elements, said pattern comprising means for defining a plurality of locations and means for associating a numeric value with each of said locations.

7. The overlay of claim 6 wherein said pattern further comprises means for defining a tell location.

8. The overlay of claim 6, wherein said defining means comprises a tinted area.

9. A method of presenting numerical information in a value indicia comprising the steps of:

(a) defining a plurality of locations in said indicia;

(b) associating a numeric value with each of said locations; and (c) printing a marker in at least one of said locations.

10. The method of claim 9, further comprising the steps of superposing an overlay upon said indicia and interpreting said marker by use of said overlay.

11. The method of claim 9, further comprising the step of randomly selecting the location in which to print the marker.

12. The method of claim 9, further comprising the steps of selecting said at least one location by applying an algorithm to numerical information, and printing alphanumeric characters as part of said indicia, said alphanumeric characters representing said numerical information.

13. The method of claim 12, wherein said selection occurs before said printing of said alphanumeric characters.

14. The method of claim 12, further comprising the steps of superposing an overlay upon said indicia and interpreting said marker by use of said overlay.

* * * * *